US008746481B2

(12) United States Patent
Ferguson

(10) Patent No.: US 8,746,481 B2
(45) Date of Patent: Jun. 10, 2014

(54) FLEXIBLE COVER FOR PRODUCE CONTAINER

(76) Inventor: Roy G Ferguson, Mississauga (CA)

( * ) Notice: Subject to any disclaimer, the term of this patent is extended or adjusted under 35 U.S.C. 154(b) by 1232 days.

(21) Appl. No.: 12/210,191

(22) Filed: Sep. 13, 2008

(65) Prior Publication Data

US 2009/0173740 A1 Jul. 9, 2009

Related U.S. Application Data

(60) Provisional application No. 61/019,800, filed on Jan. 8, 2008.

(51) Int. Cl.

| | |
|---|---|
| ***B65D 51/16*** | (2006.01) |
| ***B65D 51/12*** | (2006.01) |
| ***B65D 6/40*** | (2006.01) |
| ***B65D 90/22*** | (2006.01) |
| ***B65D 43/00*** | (2006.01) |
| ***B65D 43/16*** | (2006.01) |
| ***B65D 43/18*** | (2006.01) |
| ***B65D 65/02*** | (2006.01) |
| ***B65D 85/00*** | (2006.01) |

(52) U.S. Cl.

USPC ..... 220/203.1; 220/305; 220/361; 220/367.1; 220/745; 229/125.015; 150/154

(58) Field of Classification Search

USPC ..... 220/203.1, 305, 361, 367.1, 369, 745; 229/125.015; 150/154; 383/8, 10, 102, 383/103

See application file for complete search history.

(56) References Cited

U.S. PATENT DOCUMENTS

| | | | | |
|---|---|---|---|---|
| 2,163,017 | A | | 6/1939 | Berch |
| 2,239,571 | A | | 4/1941 | Ray |
| 2,319,924 | A | | 5/1943 | Ferguson |
| 2,779,144 | A | * | 1/1957 | Nail ..... 53/459 |
| 2,944,725 | A | | 7/1960 | Hayes |
| 3,412,893 | A | | 11/1968 | Slapnik |
| 4,053,100 | A | | 10/1977 | Baptist |
| 4,089,417 | A | | 5/1978 | Osborne |
| 4,279,374 | A | | 7/1981 | Webinger |
| 4,530,440 | A | | 7/1985 | Leong |
| 5,060,851 | A | | 10/1991 | Lorenz |
| 5,114,766 | A | | 5/1992 | Jacgues |
| 5,362,152 | A | * | 11/1994 | Fletcher et al. ..... 383/8 |
| 5,390,847 | A | | 2/1995 | Young |
| 5,562,580 | A | * | 10/1996 | Beasley et al. ..... 493/194 |
| 6,502,371 | B2 | * | 1/2003 | DeMatteis ..... 53/459 |
| 6,607,089 | B2 | | 8/2003 | Ferguson |

OTHER PUBLICATIONS

Statment of Prior Use and Sale.

* cited by examiner

*Primary Examiner* — Fenn Mathew
*Assistant Examiner* — Andrew T Kirsch
(74) *Attorney, Agent, or Firm* — James B. Conte; Husch Blackwell LLP

(57) ABSTRACT

A flexible plastic sheet cover for a produce container which is collapsible and has a plurality of ventilators wherein the improvement is having a seamed cover center and having seamless end bands that grip the end walls of the container and a method for making the cover from a tubular sheet.

5 Claims, 2 Drawing Sheets

FLEXIBLE COVER FOR PRODUCE CONTAINER

FIELD OF INVENTION

This invention concerns a plastic collapsible sheet cover designed to fit over produce container and a method for producing the same. More particularly, this invention relates to collapsible tubular plastic banded sheet covers and the method for their preparation.

BACKGROUND OF PRIOR ART

A produce shipper often uses a reusable container to ship produce. The shipper will fill the container, often reusable, with produce. To better protect the produce from the elements and from drying out a plastic film type cover is often used. My U.S. Pat. No. 6,607,089 shows a flat plastic collapsible cover that fits over produce containers. The cover is a one piece cover that has a plurality of central ventilator flaps that operate to allow air to enter the container, while at the same time protecting the produce in the container. My U.S. Patent uses four corner slits that are used to attach the cover to each of the container corners. Also I have used tubular plastic collapsible cover that had a hat shaped profile with the center portion being seamless and the projecting bands being sealed.

SUMMARY OF THE INVENTION

My produce container cover has seamless bands and a seamed center section which provides a stronger and better fitting cover for some produce containers. My preferred method of manufacturing my cover is transversely cutting and seaming a flat tubular sheet of plastic to provide a plastic bag having one end open and an opposite end seamed and both sides seamless. I then stack the bags. After a predetermined number of bags are stacked I fold the stacked bags along their longitudinal center so that the seamless sides are in contact with each other to provide a folded stack of bags. Then I cut the folded stack of bags to remove a rectangular section from the folded bags which extends from the closed end of the bag to a predetermined distance from the open end of the bag. Simultaneously the stack of folded bags are cut a predetermined distance above the open end and a predetermined distance below the closed end and a predetermined distance from each side of the bags to provide a plurality of ventilator flaps in the bags.

I provide an improved produce container flexible plastic sheet cover with a longitudinally seamed cover center that is sized to be positioned over the open end of the container. The seamed cover center portion which is positioned over the open end of the container has a plurality of ventilator flaps of the type described in my above U.S. Patent. My cover provides side sections and end bands that engage the produce container side and end walls. Also the cover is sized to have a periphery less than the periphery of the open end of the produce container so as to provide frictional engagement with the side and end walls of the produce container.

I further provide an improved one piece plastic collapsible cover for a produce container from a collapsed tubular plastic sheet. The cover when laid flat has a hat shaped profile; the hat shape profile has a rectangular hat center having a seamed top and an open base; the hat center has the plurality of ventilator flaps therein; a first rectangular band being continuous with and extending from one side of the hat center; a second rectangular band being continuous with and extending from the other side of the hat center; the first band having a closed seamless first end; the second band having a closed seamless second end; the rectangular hat center has open sides above the bands and a seamed closed top which is preferably seamed by a heat seal below a top edge of the top; the hat shaped profile having an open bottom; and the periphery of the cover is less than the periphery of the container open end.

I further provide a method to produce the above cover by transversely cutting a collapsed tubular plastic sheet and seaming (preferably by simultaneously heat sealing) the collapsed tubular plastic sheet below the cut. This is normally done on a continuous tube and the tube is cut a predetermined distance apart to provide what we will refer to as a bag in that it is closed on three sides and open on one side. The bag is folded in half with the two closed sides being stacked on one another. Then the folded bag is cut to remove a rectangular section and to provide a plurality of ventilators. When the cut bag is unfolded, it has a hat shaped profile wherein the hat shape profile has a rectangular hat center, an open bottom, with the bottom having a first rectangular band being continuous with and extending from one side of the hat center and a second rectangular band being continuous with and extending from the other side of the hat center; the hat center having a plurality of ventilator flaps; the first and second band ends being closed and seamless; providing the hat center with open sides above the bands; sealing top of the hat below a top edge of the top; and the periphery of the open bottom being less than the periphery of the container open end.

DETAILED DESCRIPTION OF THE DRAWINGS

While the present disclosure will be described fully hereinafter with reference to the accompanying drawings in which particular embodiments are shown, it is understood at the outset that persons skilled in the art may modify the disclosure herein described while still achieving the desired result of this disclosure. Accordingly, the description which follows is to be understood as a broad informative disclosure directed to persons skilled in the appropriate arts and not as limitations of the present disclosure.

Figure 1:
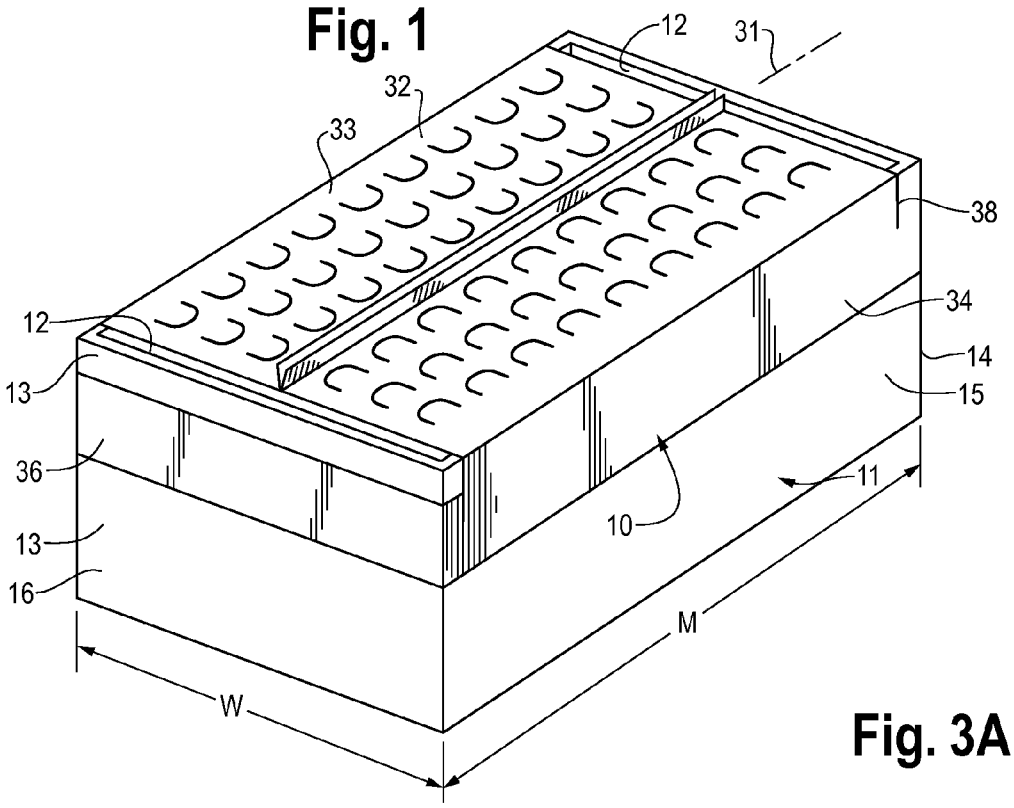
FIG. 1 is a top perspective view of the cover shown in relation to a produce container.

Referring to FIG. 1, I provide an improved flexible produce cover 10 for a produce container 11. The produce container 11 includes a top opening 12 defined by a first container end 13 and a second container end 14, and a first container side 15 and a second container side 16. My flexible cover 10 is constructed to tightly and securely engage the first and second container ends 13, 14 and the first and second container sides 15, 16. The flexible cover 10 includes a plurality of ventilators 22 in cover center portion 32.

Figure 2:
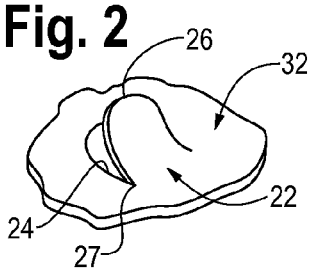
FIG. 2 is an enlarged perspective view of a ventilator flap in an upward position.

Referring to FIG. 2, the ventilators 22 are constructed to allow passage of air into container 11 and to allow for passage of gasses that result from produce respiration out of container 11. Each ventilator 22 in the cover center portion 12 includes a ventilator aperture 24 and a ventilator flap 26 which pivots at its base 27 to open and close the ventilator aperture 24.

Ventilator aperture 24 and ventilator flap 26 cooperate to allow air to enter container 11 and also to allow gasses to escape.

The flexible cover 10 includes a cover center portion 32 configured to overlap first and second container sides 15, 16 forming side walls 33, 34 on opposite sides of the cover. Flexible cover 10 has a first end band 36 and a second end band 38 opposite the first end band 36. The first end band 36 is positioned between the first and second side walls 33, 34 and configured to be in tight engagement with the first container end 13 and a small portion of the container side walls. The second end band 38 is identical to first end band 36 and is in tight engagement with second container end 14 and a small portion of the container side walls. First and second end bands 36, 38 are integral with cover center portion 32 and side walls 33, 34 and together form cover 10.

Figure 3A:
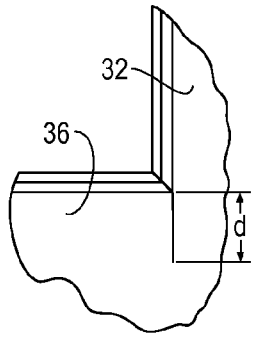
FIG. 3 is a side view of my cover prior to it being put on a produce container.
Figure 3:
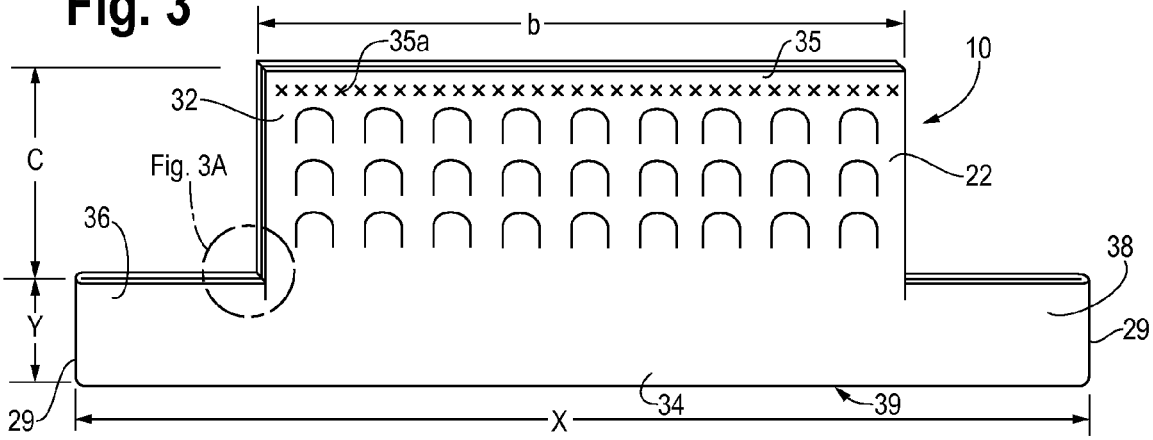

Referring to FIG. 3, this shows the cover in a flat position. In this position, the cover has the profile shape of a hat with a rectangular center 32 having the first rectangular band 36 extending substantially perpendicular from the left side of the rectangular center 32 and the second band 38 extending substantially perpendicular from the right side of the rectangular center 32. The top of the hat center is seamed, preferably heat sealed 35A which is below the top edge 35. This type of seal provides better center strength and helps hold the cover off the contents of the container when it is placed on the container. The band ends 29 are preferably seamless but could be heat sealed if desired.

Referring to FIG. 3A, in some embodiments it is desirable to cut the sides of the center portion of the cover a distance d, about 1.5-3.0 cm, below the top of the bands. This gives the cover a better snug fit on most containers.

Figure 4:
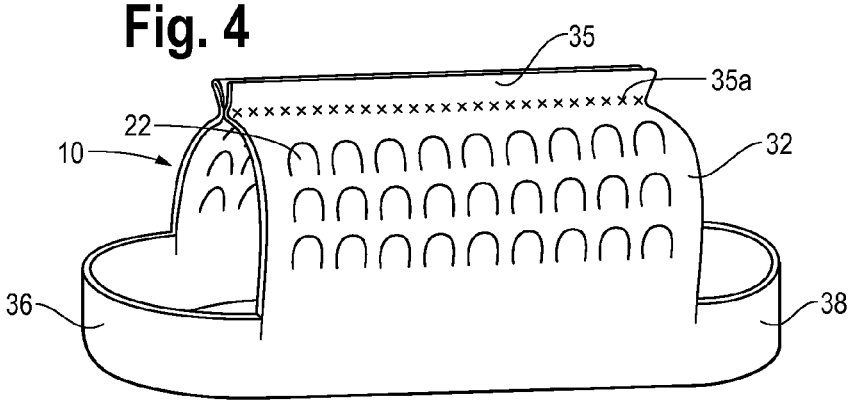
FIG. 4 is a perspective of the cover of FIG. 3 partially open.

FIG. 4 shows the cover partially open to clearly show that the band 36 and 38 are preferably seamless and the center section 32 is seamed along its longitudinal center line 31 (FIG. 1).

Figure 5:
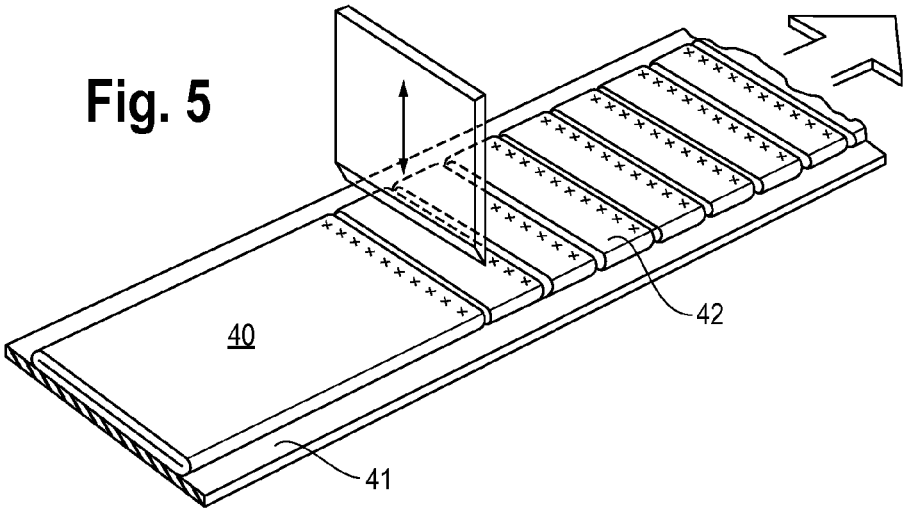
FIGS. 5 and 6 illustrate a method of preparing the cover of FIG. 3.

As illustrated in FIG. 5, the flexible cover 10 is formed from an extruded plastic tube 40. The sheet 40 is continuously fed along an appropriate conveyor 41 and is transversely cut and heat sealed to provide bags 42. The bags 42 are removed from the conveyor and preferably stacked. The amount of bags stacked is determined by the type of plastic used.

Figure 6:
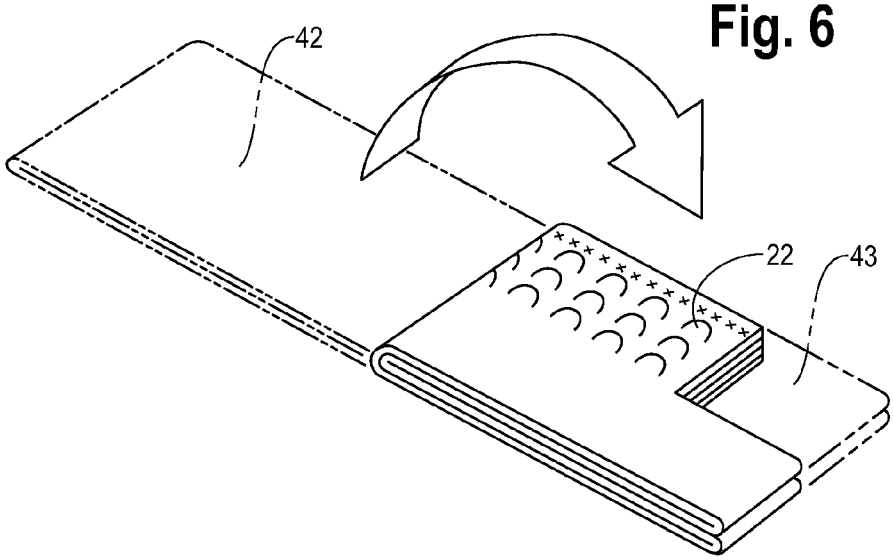

Referring to FIG. 6 there is shown one bag 42 being folded for illustrative purposes. However, in practice the stack contains a plurality of bags that are folded so that the continuous seamless sides of the bags are folded to each other. The folded stack is then inserted into a die cut press where sections 43 are cut out and removed and the ventilator flaps 22 are formed. The folded covers are now packed into cartons for shipping. The circumference of tubular film 30 is selected to be less than the perimeter of the open top of produce container 11, as defined by first container end 13, first container side 15, second container end 14, and second container side 16. Flexible cover 10 is thus configured to engage container 11 and to be in tight engagement with the container end walls 13, 14 and the container side walls 14, 16 and provide a secure frictional fit.

Container sizes may vary but a widely used collapsible hard plastic fruit container has a length M of about 23.5 inches and a width W of about 15.5 inches (a 78 inch perimeter). For this type of container, my cover 10 as shown in FIG. 3, is made of low density polyethylene, and generally the cover 10 has a bottom length X of about 37.5 inches, a band height Y of about 2 to 2.75 inches and a hat width b of 21.5 inches a central height c of 8.25 to 9 inches. Thus in this instance, the perimeter of the band (75.0 inches) is about 3 inches less than the perimeter of the fruit container. This allows the cover to provide a tight fit on the container without needing excess force to do so. The amount the perimeter of the cover is less than the perimeter of the container it is to be used on, depends on the type of plastic and the thickness of the plastic.

Although linear low density polyethylene (LLDPE) is generally used, they can also have added thereto the additives EPI TDPA and/or PrimePro. Also the flexible cover may be constructed from any of a number of polymeric materials, or plastic films, known in the art, including high density polyethylene (HDPE), low density polyethylene (LDPE), polyethylene terephthalate (PET), ethylene vinyl acetates (EVA), polypropylenes, cast polypropylene (CPP), polyolefin's, nylons, biaxially oriented polypropylene (BOPP), and/or combinations thereof, depending on the specific application. The flexible cover may also include a cloth or paper material, either alone or in combination with the polymeric materials described.

As is known in the art, polymeric films may have various characteristics based upon the particular polymers from which they are made. My preferred cover is an opaque or white thermoplastic film to reflect sunshine and one which can easily be printed on and/or is degradable and/or extends shelf life. Also, depending on a particular application, it may be desirable for the thermoplastic film forming flexible cover to be stretchable, providing a positive bias for securing flexible cover to the container. In another application, it may be desirable for the thermoplastic film to have minimal stretch. In yet another application, it may be desirable to formulate the thermoplastic film such that the film is transparent to allow an observer to see the contents of the container.

Therefore, while embodiments have been illustrated and described in the drawings and foregoing description, such illustrations and descriptions are considered to be exemplary and not restrictive in character, it being understood that only an illustrative embodiment has been shown and described and that all changes and modifications that come within the spirit of the invention are desired to be protected. The applicant has provided description and figures which are intended as an illustration of certain embodiments of the disclosure, and are not intended to be construed as containing or implying limitation of the disclosure to those embodiments. There are several advantages of the present disclosure arising from various features set forth in the description. It will be noted that alternative embodiment of the disclosure may not include all of the features described yet still benefit from at least some of the advantages of such features. Those of ordinary skill in the art may readily devise their own implementations of the disclosure and associated methods that incorporate one or more of the feature of the disclosure and fall within the spirit and scope of the present disclosure as defined by the following claims.

I claim:

1. A collapsible cover for a produce container having an open top, the collapsible cover comprising:

a flat tube of sheet material having a first side, a second side, a sealed top end and an open bottom end, said open bottom end having an open bottom length and configured to receive a produce container;

a first rectangular cut-out in said flat tube wherein a portion of said first side and said sealed end are removed, said first cut out defining an open top side of a first rectangular band and an open first side of a center portion;

a second rectangular cut-out in said flat tube wherein a portion of said second side and said sealed end are removed, said second cut-out defining an open top side of a second rectangular band and an open second side of said center portion;

said first rectangular cut-out and said second rectangular cut-out having the substantially same area;

wherein said center portion is defined by the remainder of said sealed top end defining a sealed top length, said first open side and said second open side, and wherein said sealed top length is less than said open bottom length, and wherein said center portion has a plurality of vents cut therein, and wherein said sealed top end is sealed at a seam.

2. The collapsible cover of claim 1 wherein, the sealed top end is seamed by being heat sealed.

3. The collapsible cover of claim 1 wherein, the first rectangular band and the second rectangular band are seamless.

4. The plastic collapsible cover of claim 1 wherein, the height of each first and second rectangular band is about 2-2.75 inches.

5. The plastic collapsible cover of claim 1 wherein said sealed top end covers said open top of said produce container when said open end is slid over said container.

* * * * *